US010189256B2

(12) United States Patent
Kobayashi

(10) Patent No.: US 10,189,256 B2
(45) Date of Patent: Jan. 29, 2019

(54) LIQUID EJECTING APPARATUS

(71) Applicant: SEIKO EPSON CORPORATION, Tokyo (JP)

(72) Inventor: Haruki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/642,649

(22) Filed: Jul. 6, 2017

(65) Prior Publication Data

US 2018/0015720 A1 Jan. 18, 2018

(30) Foreign Application Priority Data

Jul. 15, 2016 (JP) ..... 2016-140026

(51) Int. Cl.
*B41J 2/14* (2006.01)
*B41J 2/175* (2006.01)

(52) U.S. Cl.
CPC ..... *B41J 2/1433* (2013.01); *B41J 2/14233* (2013.01); *B41J 2/175* (2013.01); *B41J 2/17509* (2013.01); *B41J 2/17596* (2013.01); *B41J 2002/14362* (2013.01); *B41J 2002/14419* (2013.01)

(58) Field of Classification Search
CPC .. B41J 2/17523; B41J 2/1752; B41J 2/17513; B41J 2/17509; B41J 2002/14306; B41J 2/175; B41J 2/145; B41J 2/15; B41J 2/14; B41J 2/1433
See application file for complete search history.

(56) References Cited

U.S. PATENT DOCUMENTS 6,152,558 A * 11/2000 Togashi ..... B41J 2/1752 347/49
2004/0075721 A1 4/2004 Ohashi et al.
2004/0076447 A1* 4/2004 Matsuo ..... B41J 2/17513 399/110
2007/0188563 A1* 8/2007 Takahashi ..... B41J 2/17509 347/84

FOREIGN PATENT DOCUMENTS

CN 1496841 A 5/2004
JP 2015/123677 A 7/2015
JP 2015-223774 A 12/2015

* cited by examiner

*Primary Examiner* — Henok Legesse
(74) *Attorney, Agent, or Firm* — Workman Nydegger

(57) ABSTRACT

A liquid ejecting apparatus includes a head that ejects an ink while moving in an X direction, a plurality of liquid retention portions that are arranged in a direction that intersects the X direction and retain the ink, a mounting portion in which the plurality of liquid retention portions are mounted, and a plurality of flow channels that are provided in the mounting portion and supply the ink to the head from the plurality of liquid retention portions, in which the plurality of liquid retention portions include a liquid retention portion that retains a black ink, and, among flow channel lengths of the plurality of flow channels, the flow channel length of a flow channel that supplies the black ink is shortest.

7 Claims, 11 Drawing Sheets

LIQUID EJECTING APPARATUS

This application claims priority under 35 U.S.C. § 119 to Japanese Patent Application No. 2016-140026 filed on Jul. 15, 2016, the entire disclosure of which is expressly incorporated by reference herein.

BACKGROUND

1. Technical Field

The present invention relates to a liquid ejecting apparatus.

2. Related Art

A liquid ejecting apparatus that ejects a liquid such as ink, which is supplied from a liquid container (a cartridge), from a nozzle has been proposed in the related art. For example, JP-A-2015-123677 discloses a serial type liquid ejecting apparatus in which a liquid container is mounted in a box form carriage in which a liquid ejecting head is installed, and the carriage is caused to reciprocate with respect to a medium such as printing paper.

Furthermore, a liquid ejecting head provided with a liquid ejecting portion, a plurality of cartridges that store ink, a fixing body that fixes the cartridges, and a flow channel plate that forms a flow channel of liquid with a fixing plate has been disclosed as a liquid ejecting head that is suitable in a liquid ejecting apparatus (for example, JP-A-2015-223774).

The liquid ejecting head disclosed in JP-A-2015-223774 can rapidly discharge a liquid that flows out from the cartridges, and is reduced in size as a result of disposing the cartridges in a two-dimensional manner.

However, in a liquid ejecting apparatus in which the liquid ejecting head (liquid ejecting head unit) disclosed in JP-A-2015-223774 is mounted, flow channels of liquid that run from the cartridges to the liquid ejecting portion (head) are not optimized, and therefore, there is a concern that defects (for example, the omission of dots) will occur as a result of the fact that the flow channels of liquid are not optimized.

SUMMARY

The invention can be realized as the following aspects or application examples.

Application Example 1

According to this application example, there is provided a liquid ejecting apparatus including a head that ejects a liquid while moving in a scanning direction, a plurality of liquid retention portions that are arranged in a direction that intersects the scanning direction and retain the liquid, a mounting portion in which the plurality of liquid retention portions are mounted, and a plurality of flow channels that are provided in the mounting portion and supply the liquid to the head from the plurality of liquid retention portions, in which the plurality of liquid retention portions include a black liquid retention portion that retains a black liquid, and, among flow channel lengths of the plurality of flow channels, a flow channel length of a flow channel that supplies the black liquid is shortest.

According to this application example, the liquid ejecting apparatus records (prints) a desired image on a medium by forming dots on the medium as a result of ejecting the liquid from the head. In addition, in comparison with dots formed using other colors, black dots formed using the black liquid are easier to recognize visually, stand out more as a result. Therefore, if it is likely that a defect (for example, the omission of dots) will occur in the black dots formed on the medium as a result of the head ejecting the black liquid, it is likely that the defect will lead to a deterioration in the appearance quality of an image recorded on the medium. Meanwhile, when it is unlikely that a defect will occur in the black dots formed on the medium as a result of the head ejecting the black liquid, it is possible to enhance the appearance quality of an image recorded on the medium.

Furthermore, if a flow channel that supplies the liquid is long and the flow channel resistance of a flow channel that supplies the liquid is high, since it is unlikely that the liquid will be ejected from the head, it is likely that a defect (for example, the omission of dots) will occur as a result of the liquid not being ejected from the head properly. When the flow channel resistance of a flow channel that supplies the liquid is low, since it is likely that the liquid will be ejected from the head properly, it is unlikely that a defect will occur as a result of the liquid not being ejected from the head properly.

According to the application example, since the flow channel length of the flow channel that supplies the black liquid is the shortest, and therefore, the flow channel resistance of the flow channel that supplies the black liquid is the lowest, it is likely that the black liquid will be ejected from the head properly, it is unlikely that a defect (for example, the omission of black dots) will occur as a result of the black liquid not being ejected from the head properly, and therefore, it is possible to enhance the appearance quality of an image recorded on the medium.

Application Example 2

In the liquid ejecting apparatus according to the application example, it is preferable that at least a portion of the black liquid retention portion be disposed so as to overlap with the head when viewed in a planar manner.

If at least a portion of a black liquid retention portion is disposed so as to overlap with the head when viewed in a planar manner, it is possible to dispose a discharge opening for black liquid of the black liquid retention portion and an introduction opening for black liquid of the head so as to overlap with one another when viewed in a planar manner, and therefore, it is possible to reduce the flow channel length of the flow channel that runs from the discharge opening to the introduction opening in comparison with a case in which the discharge opening and the introduction opening do not overlap with one another when viewed in a planar manner.

That is, if a discharge opening and an introduction opening are disposed so as to overlap with one another when viewed in a planar manner, it is possible to make the flow channel length of a flow channel of the black liquid that runs from the discharge opening to the introduction opening the shortest.

Application Example 3

According to another application example, there is provided a liquid ejecting apparatus including a head that ejects a liquid while moving in a scanning direction, a plurality of liquid retention portions having different retention capacities that are arranged in a direction that intersects the scanning direction and retain the liquid, a mounting portion in which the plurality of liquid retention portions are mounted, and a plurality of flow channels that are provided in the mounting portion and supply the liquid to the head from the plurality of liquid retention portions, in which, among flow channel lengths of the plurality of flow channels, a flow channel length of a flow channel that supplies a liquid retained in a liquid retention portion having a greatest retention capacity is shortest.

The liquid retained in the liquid retention portion having the greatest retention capacity is a liquid having a high frequency of use that is often ejected from the head and that is often consumed. Furthermore, when the frequency of use of a liquid is high, in comparison with a case in which the frequency of use of a liquid is low, it is likely that defects will occur in the dots formed by the liquid. Therefore, if it is likely that a defect (for example, the omission of dots) will occur in the dots formed on the medium as a result of the head ejecting a liquid retained in a liquid retention portion having the greatest retention capacity (hereinafter, referred to as a liquid having a high frequency of use), it is likely that the defect will lead to a deterioration in the appearance quality of an image recorded on the medium. Meanwhile, if it is unlikely that a defect will occur in the dots formed on the medium even if the head ejects a liquid having a high frequency of use, it is possible to enhance the appearance quality of an image recorded on the medium.

According to the application example, since the flow channel length of the flow channel that supplies the liquid having a high frequency of use is the shortest, and therefore, the flow channel resistance of the flow channel that supplies the liquid having a high frequency of use is the lowest, it is most likely that the liquid having a high frequency of use will be ejected from the head, it is unlikely that a defect (for example, the omission of dots) will occur as a result of the liquid having a high frequency of use not being ejected from the head properly, and therefore, it is possible to enhance the appearance quality of an image recorded on the medium.

Application Example 4

In the liquid ejecting apparatus according to the application example, it is preferable that at least a portion of the liquid retention portion having the greatest retention capacity is disposed so as to overlap with the head when viewed in a planar manner.

If at least a portion of a liquid retention portion that retains a liquid having a high frequency of use is disposed so as to overlap with the head when viewed in a planar manner, it is possible to dispose a discharge opening for the liquid having a high frequency of use of the liquid retention portion and an introduction opening for the liquid having a high frequency of use of the head so as to overlap with one another when viewed in a planar manner, and therefore, it is possible to reduce the flow channel length of the flow channel that runs from the discharge opening to the introduction opening in comparison with a case in which the discharge opening and the introduction opening do not overlap with one another when viewed in a planar manner.

That is, if a discharge opening and an introduction opening are disposed so as to overlap with one another when viewed in a planar manner, it is possible to make the flow channel length of a flow channel of the liquid having a high frequency of use that runs from the discharge opening to the introduction opening the shortest.

Application Example 5

According to still another application example, there is provided a liquid ejecting apparatus including a head that ejects a liquid while moving in a scanning direction, a plurality of liquid retention portions that are arranged in a direction that intersects the scanning direction and retain the liquid, a mounting portion in which the plurality of liquid retention portions are mounted, and a plurality of flow channels that are provided in the mounting portion and supply the liquid to the head from the plurality of liquid retention portions, in which, among flow channel lengths of the plurality of flow channels, a flow channel length of a flow channel that supplies a liquid having a greatest consumption amount among liquids retained in the plurality of liquid retention portions, is shortest.

The liquid having the greatest consumption amount is a liquid having the highest frequency of use. Furthermore, when the frequency of use of a liquid is high, in comparison with a case in which the frequency of use of a liquid is low, it is likely that defects will occur in the dots formed by the liquid. Therefore, if it is likely that a defect (for example, the omission of dots) will occur in the dots formed on the medium as a result of the head ejecting the liquid having the highest consumption amount, it is likely that the defect will lead to a deterioration in the appearance quality of an image recorded on the medium. Meanwhile, if it is unlikely that a defect will occur in the dots formed on the medium even if the head ejects the liquid having the highest consumption amount, it is possible to enhance the appearance quality of an image recorded on the medium.

According to the application example, since the flow channel length of the flow channel that supplies the liquid having the highest consumption amount is the shortest, and therefore, the flow channel resistance of the flow channel that supplies the liquid having the highest consumption amount is the lowest, it is most likely that the liquid having the highest consumption amount will be ejected from the head, it is unlikely that a defect (for example, the omission of dots) will occur as a result of the liquid having the highest consumption amount not being ejected from the head properly, and therefore, it is possible to enhance the appearance quality of an image.

Application Example 6

In the liquid ejecting apparatus according to the application example, it is preferable that at least a portion of a liquid retention portion that retains the liquid for which the consumption amount is greatest be disposed so as to overlap with the head when viewed in a planar manner.

If at least a portion of a liquid retention portion that retains the liquid having the highest consumption amount is disposed so as to overlap with the head when viewed in a planar manner, it is possible to dispose a discharge opening for the liquid having the highest consumption amount of the liquid retention portion and an introduction opening for the liquid having the highest consumption amount of the head so as to overlap with one another when viewed in a planar manner, and therefore, it is possible to reduce the flow channel length of the flow channel that runs from the discharge opening to the introduction opening in comparison with a case in which the discharge opening and the introduction opening do not overlap with one another when viewed in a planar manner.

That is, if a discharge opening and an introduction opening are disposed so as to overlap with one another when viewed in a planar manner, it is possible to make the flow channel length of a flow channel of the liquid having the highest consumption amount that runs from the discharge opening to the introduction opening the shortest.

Application Example 7

It is preferable that the liquid ejecting apparatus according to the application example further include a support body that supports the head, and a guide shaft that supports the support body and sets the support body to be capable of moving in the scanning direction, and that, in the support body, the head be supported on a side that is close to the guide shaft.

If an excessive force is applied to the support body or the head, the support body supported by the guide shaft rotates with the guide shaft as a pivot point thereof, and the position of the support body changes. Furthermore, the head supported by the support body also rotates with the guide shaft as a pivot point thereof, and the position of the head changes.

If the head is supported on a side that is close to the guide shaft in a case in which the head rotates with the guide shaft as a pivot point thereof due to an excessive force, in comparison with a case in which the head is supported on a side that is far from the guide shaft, it is possible to reduce a change in the position of the head that arises due to rotation with the guide shaft as a pivot point thereof.

If the change in the position of the head is reduced, positional shift of liquid droplets to be deposited on the medium as a result of being ejected from the head is reduced, and therefore, it is possible to enhance the appearance quality of an image formed on the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description of Embodiments

Figure 1:
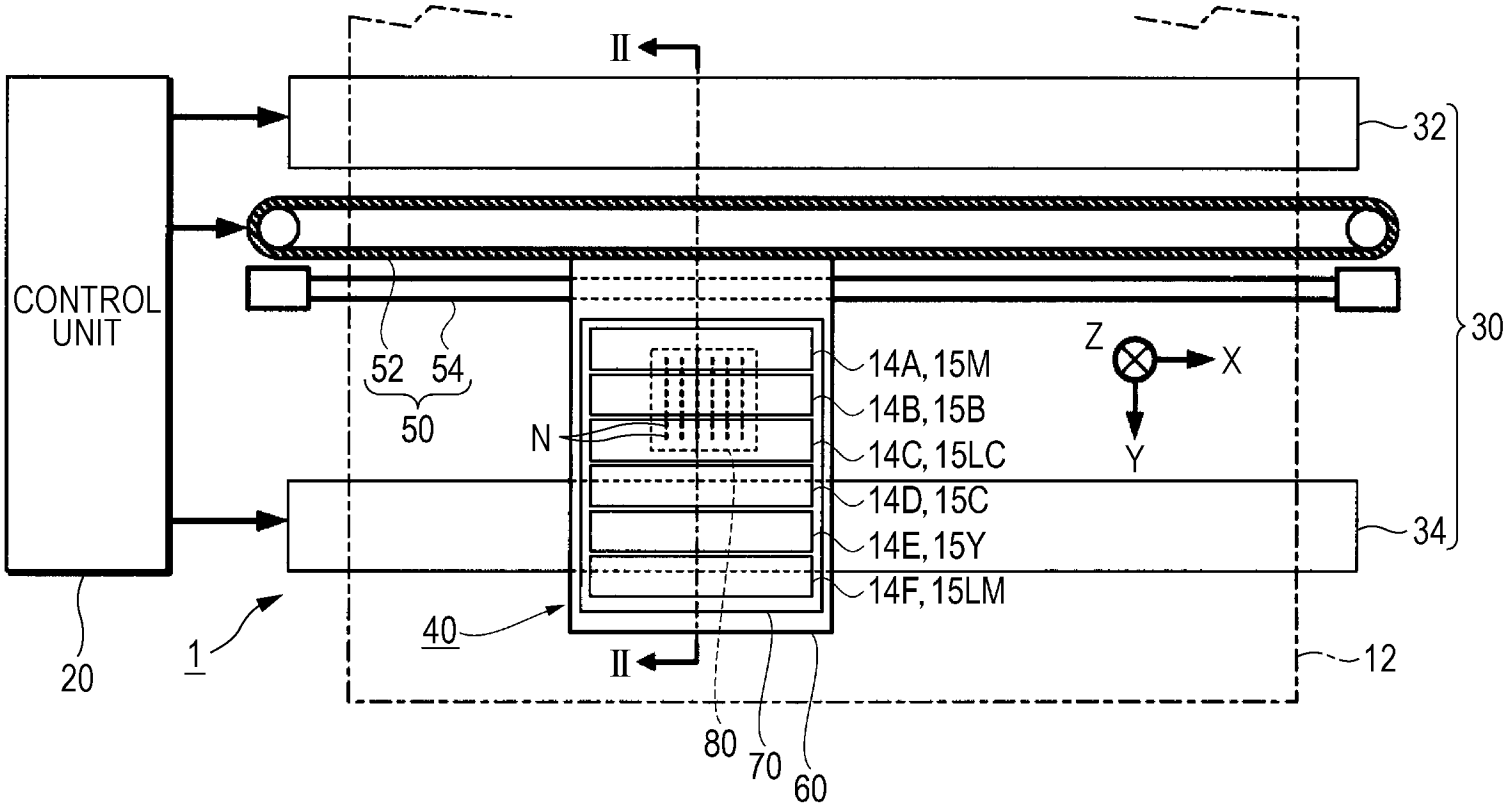
FIG. 1 is a configuration view of a liquid ejecting apparatus according to Embodiment 1.

Hereinafter, embodiments of the invention will be described with reference to the drawings. The embodiments illustrate aspects of the invention, but do not limit the invention, and can be changed arbitrarily within a range of the technical idea of the invention. In addition, in each of the drawings below, the scales are altered for each layer and each location in order to make each layer and each location have a size that is easy to understand in the drawings.

Embodiment 1

FIG. 1 is a configuration view of a liquid ejecting apparatus according to Embodiment 1.

A liquid ejecting apparatus 1 according to the present embodiment is an ink jet type printing apparatus that ejects an ink 15, which is one example of a "liquid", onto a medium 12. A typical example of the medium 12 is printing paper, but it is also possible to use various media such as a fabric or a resin film.

As shown in FIG. 1, the liquid ejecting apparatus 1 is provided with a control unit 20, a transport mechanism 30, a liquid ejecting unit 40, and a movement mechanism 50. For example, the control unit 20 is configured to include a control device such as a central processing unit (CPU) and a storage circuit such as semiconductor memory (not illustrated in the drawings), and controls each component of the liquid ejecting apparatus 1 in an integral manner as a result of the control device executing a program stored in a storage circuit.

The transport mechanism 30 transports the medium 12 in a Y direction on the basis of the control by the control unit 20. The transport mechanism 30 includes a supply side transport mechanism 32 and a discharge side transport mechanism 34. The transport mechanism 32 is installed on an upstream side (the negative side in the Y direction) of the transport mechanism 34 and supplies the medium 12 to the transport mechanism 34 side, and the transport mechanism 34 discharges the medium 12 supplied from the transport mechanism 32 to a downstream side (the positive side in the Y direction).

Additionally, the Y direction is a transport direction of the medium 12, and is an example of "a direction that intersects a scanning direction".

The liquid ejecting unit 40 is a component that ejects a plurality of types of ink 15 onto the medium 12, and includes a support body 60, a mounting portion 70, and a head 80. The support body 60 is a substantially box form housing (carriage) that supports the mounting portion 70 and the head 80. The mounting portion 70 holds a plurality of liquid retention portions 14, which retain different types of ink (the plurality of types of ink).

For example, the liquid retention portions 14 are cartridges (liquid containers) that retain the ink 15. Six types (six colors) of the ink 15 are used in the present embodiment. To explain in more detail, the ink 15 used in the present embodiment is configured by a cyan (C) ink 15C, a magenta (M) ink 15M, a yellow (Y) ink 15Y, a black (B) ink 15B, a light cyan (LC) ink 15LC, and a light magenta (LM) ink 15LM.

Additionally, the black (B) ink 15B is an example of "a black liquid". Furthermore, from this point onwards, there are cases in which the types of ink 15C, 15M, 15Y, 15B, 15LC, and 15LM will be referred to collectively as the ink 15. In addition, more than six types of the ink 15 may be used, or less than six types of the ink 15 may be used.

The ink 15 includes a color material, a solvent in which a color material is dispersed (or dissolved), or the like. For example, the color material is a pigment or a dye. For example, the solvent is a water-based medium or an organic solvent. Furthermore, in addition to a color material and a solvent, the ink 15 may include a basic catalyst, a surfactant, a tertiary amine, a resin, a pH adjusting agent, a buffer solution, a fixing agent, an antiseptic, an antioxidant or an ultraviolet absorber, a chelating agent, an oxygen absorber, or the like.

A liquid retention portion 14A in which the magenta (M) ink 15M is retained, a liquid retention portion 14B in which the black (B) ink 15B is retained, a liquid retention portion 14C in which the light cyan (LC) ink 15LC is retained, a liquid retention portion 14D in which the cyan (C) ink 15C is retained, a liquid retention portion 14E in which the yellow (Y) ink 15Y is retained, and a liquid retention portion 14F in which the light magenta (LM) ink 15LM is retained are mounted in the mounting portion 70, arranged along the Y direction. Each of the liquid retention portions 14A, 14B, 14C, 14D, 14E, and 14F can be attached and detached to and from the mounting portion 70 in an individual manner.

Additionally, the liquid retention portion 14B that retains the black (B) ink 15B is an example of "a black liquid retention portion". Furthermore, there are cases in which the liquid retention portions 14A, 14B, 14C, 14D, 14E, and 14F will simply be referred to as the liquid retention portions 14.

As a result of arranging the six liquid retention portions 14A, 14B, 14C, 14D, 14E, and 14F in the Y direction (the transport direction of the medium 12), in comparison with a case in which the six liquid retention portions 14A, 14B, 14C, 14D, 14E, and 14F are arranged in an X direction (the width direction of the medium 12), the dimension of the liquid ejecting apparatus 1 in the X direction (the dimension in the width direction) is smaller, and therefore, it is possible to reduce the size of the liquid ejecting apparatus 1.

Nozzles N that eject the ink 15 onto the medium 12 are provided in the head 80. To explain in more detail, a nozzle N that ejects the magenta (M) ink 15M, a nozzle N that ejects the black (B) ink 15B, a nozzle N that ejects the light cyan (LC) ink 15LC, a nozzle N that ejects the cyan (C) ink 15C, a nozzle N that ejects the yellow (Y) ink 15Y, and a nozzle N that ejects the light magenta (LM) ink 15LM are provided in the head 80.

The head 80 records (prints) text (characters), images, and the like on the medium 12 by forming dots of colors that correspond to the types of ink 15C, 15M, 15Y, 15B, 15LC, and 15LM on the medium 12 as a result of ejecting the types of ink 15C, 15M, 15Y, 15B, 15LC, and 15LM from the nozzles N.

In the liquid ejecting apparatus 1, since text printing, black and white printing, and the like, are executed often, the consumption amount of the black (B) ink 15B is the greatest. Therefore, the black (B) ink 15B is an example of "a liquid having the greatest consumption amount".

The movement mechanism 50 is a mechanism that causes the liquid ejecting unit 40 to reciprocate in the X direction on the basis of the control by the control unit 20. The X direction is a direction in which the liquid ejecting unit 40 moves, is an example of "a scanning direction", and intersects the Y direction in which the medium 12 is transported. The movement mechanism 50 includes a transport belt 52, a guide shaft 54, and a driving motor (not illustrated in the drawings). The transport belt 52 is an endless belt that is provided in a hanging manner that is longitudinal in the X direction, and rotates as a result of the motive power of the driving motor. The support body 60 of the liquid ejecting unit 40 is fixed to the transport belt 52. The guide shaft 54 is a shaft body that is inserted through the support body 60 and extends in the X direction. The guide shaft 54 supports the support body 60, and is capable of moving the support body 60 in the X direction.

That is, the support body 60 is supported by the guide shaft 54, and reciprocates between the positive side and the negative side in the X direction due to the movement mechanism 50 (the transport belt 52, the guide shaft 54, the driving motor (not illustrated in the drawings), and the like).

The head 80 is supported by the support body 60. The head 80 moves together with the support body 60, and therefore, is capable of moving in the X direction. The head 80 records characters, images, and the like on the medium 12 by ejecting the ink 15 onto the medium 12 while moving in the X direction (the scanning direction).

To explain in more detail, characters, images, and the like, are recorded on the medium 12 by aligning rows of dots (raster lines) arranged in the X direction (the scanning direction) in the Y direction (the transport direction) as a result of alternately repeating an ink ejection operation in which the ink 15 is ejected in the head 80 while moving in which X direction (the scanning direction), and a transport operation in which the transport mechanism 32 feeds the medium 12 in the Y direction (the transport direction).

In other words, desired characters, images, and the like, are formed on the medium 12 as a result of the head 80 ejecting the ink 15 as ink droplets and causing the ink droplets to be deposited in reference positions on the medium 12.

In this manner, the liquid ejecting apparatus 1 is provided with the head 80 that ejects the ink 15 while moving in the X direction, the plurality of the liquid retention portions 14 that are arranged in a direction (the Y direction) that intersects the X direction and retain the ink 15, and the mounting portion 70 in which the plurality of liquid retention portions 14 are mounted.

In addition, from this point onwards, a direction perpendicular to an X-Y plane will be set as a Z direction. The ink 15 (ink droplets) ejected from the head 80 (the nozzles N) is deposited on the outer surface of the medium 12 as a result of traveling to the positive side in the Z direction.

Figure 2:
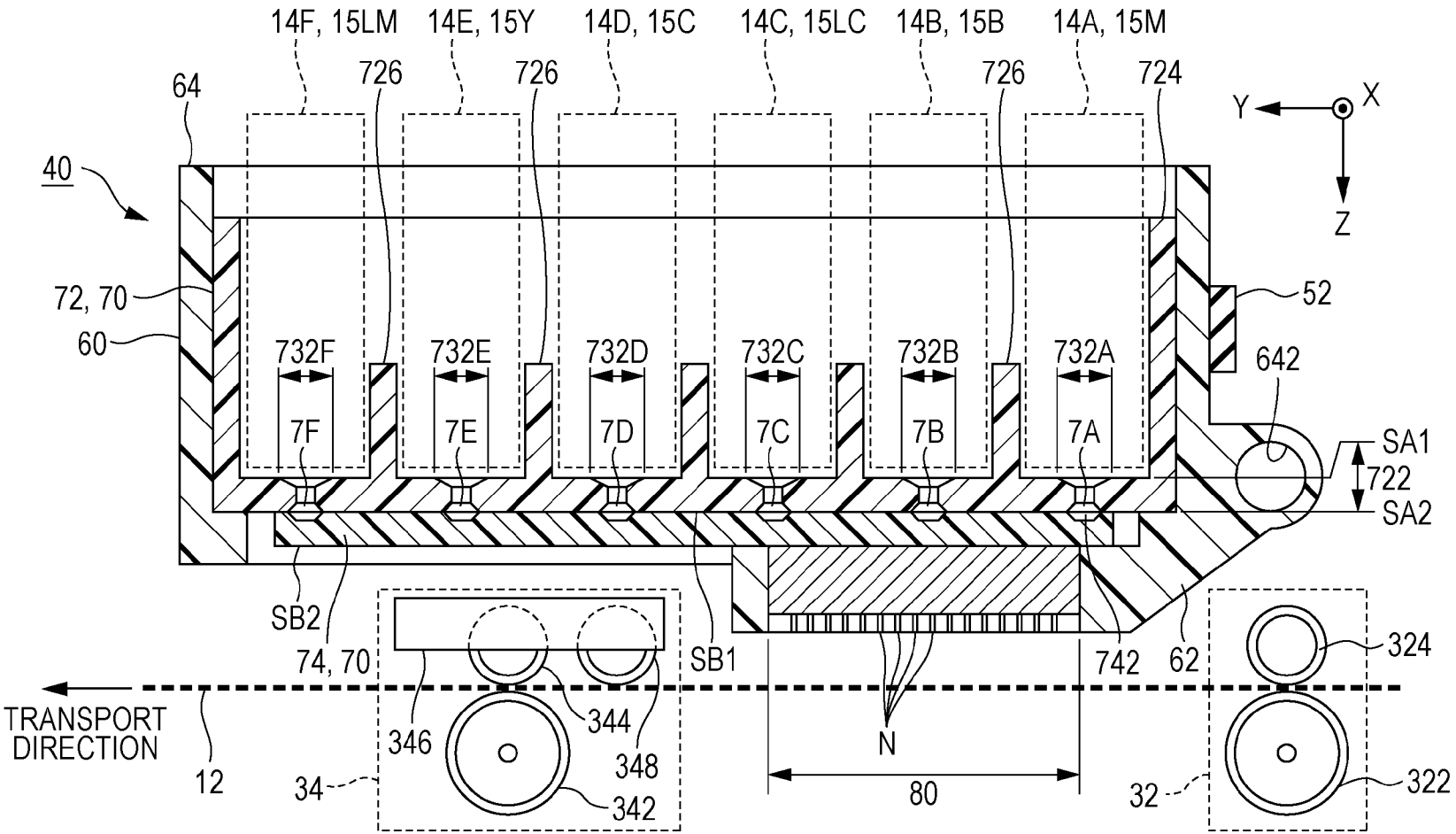
FIG. 2 is a cross-sectional view along a line II-II in FIG. 1.

FIG. 2 is a cross-sectional view along a line II-II in FIG. 1 (a cross-section that is parallel to a Y-Z plane).

As shown in FIG. 2, the transport mechanism 32 includes a supply roller 322 and a supply roller 324 in which the central axes are parallel to the X direction. The medium 12 is transported in the Y direction passing through both the supply roller 322 and the supply roller 324 due to rotation of one or both of these rollers.

The transport mechanism 34 includes a discharge roller 342 and a discharge roller 344 in which the central axes are parallel to the X direction, a structural body 346 (a frame) that supports the discharge roller 342 and the discharge roller 344, and a regulation roller 348 that is supported by the structural body 346 and regulates uplift of the medium 12. The medium 12 supplied from the transport mechanism 32 reaches the transport mechanism 34 passing through a space below the head 80, and is discharged to the downstream side passing through both the discharge roller 342 and the discharge roller 344 as a result of rotation of one or both of these rollers.

The support body 60 is a substantially box form structural body that includes a bottom surface portion 62 and a peripheral wall portion 64, and for example, is formed by injection molding of a resin material. An insertion hole 642, through which the guide shaft 54 is inserted, is formed in the peripheral wall portion 64. The support body 60 is supported by the guide shaft 54 as a result of inserting the guide shaft 54 into the insertion holes 642.

The head 80 is fixed to the bottom surface portion 62 of the support body 60. In the support body 60, the head 80 is supported on a side that is close to the guide shaft 54.

In this manner, the liquid ejecting apparatus 1 is further provided with the support body 60 that supports the head 80, and the guide shaft 54 that supports the support body 60 and is capable of moving the support body 60 in the X direction, and in the support body 60, the head 80 is supported on the side that is close to the guide shaft 54.

If an excessive force is applied to the support body 60 or the head 80, the support body 60 supported by the guide shaft 54 rotates with the guide shaft 54 as a pivot point thereof, and the position of the support body 60 changes. Furthermore, the head 80 supported by the support body 60 also rotates with the guide shaft 54 as a pivot point thereof, and the position of the head 80 changes.

Furthermore, if the head 80 is supported on a side that is close to the guide shaft 54 in a case in which the head 80 rotates with the guide shaft 54 as a pivot point thereof due to an excessive force being applied to the support body 60 or the head 80, in comparison with a case in which the head 80 is supported on a side that is far from the guide shaft 54, it is possible to reduce a change in the position of the head 80 that arises due to rotation with the guide shaft 54 as a pivot point thereof. Further, if the change in the position of the head 80 is reduced, the ink 15 (ink droplets) ejected from the head 80 are accurately deposited in reference positions on the medium 12, and therefore, it is possible to enhance the appearance quality of an image recorded on the medium 12.

Figure 3:
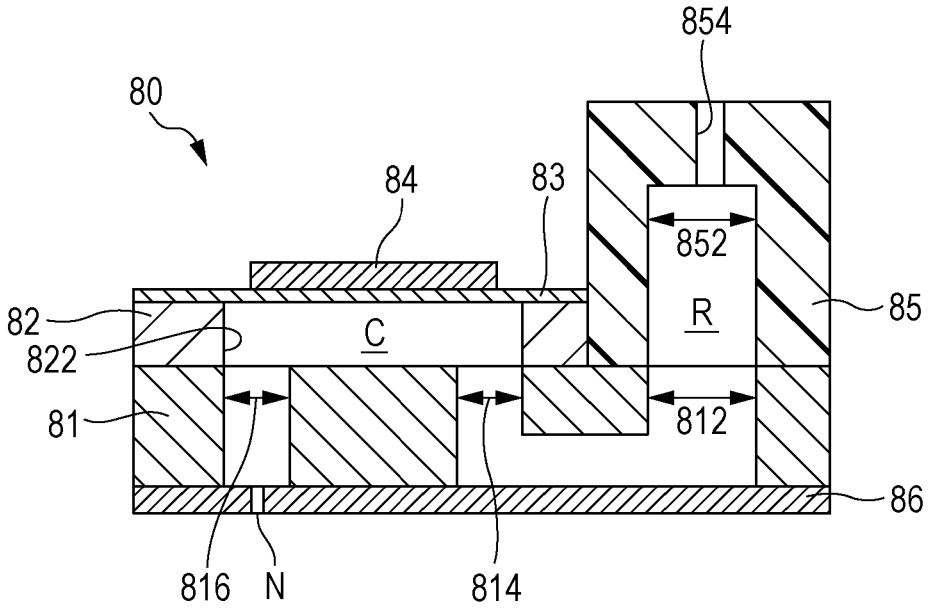
FIG. 3 is a cross-sectional view focusing on a single arbitrary nozzle among nozzles formed in a head.

FIG. 3 is a cross-sectional view focusing on a single arbitrary nozzle among the nozzles formed in the head.

As shown in FIG. 3, the head 80 is a structural body in which a pressure chamber substrate 82, a vibration plate 83, a piezoelectric element 84, and a housing portion 85 are disposed on one side of a flow channel substrate 81, and a nozzle plate 86 is disposed on the other side. For example, the flow channel substrate 81, the pressure chamber substrate 82, and the nozzle plate 86 are formed by a silicon flat plate material, and, for example, the housing portion 85 is formed by injection molding of a resin material.

The plurality of nozzles N are formed in the nozzle plate 86. The respective plurality of nozzles N are cross-sectionally circular through holes having the Z direction as the axial direction (the direction of the central axis) thereof. Nozzle rows (refer to FIG. 1) in which a plurality of nozzles N that eject a single type of the ink 15, which is supplied from a single arbitrary liquid retention portion 14, are arranged in the Y direction, are arranged in the X direction mutually spaced apart in the plurality of liquid retention portions 14.

An opening portion 812, a branched flow channel (a narrowing flow channel) 814, and a communication flow channel 816 are formed in the flow channel substrate 81. The branched flow channel 814 and the communication flow channel 816 are through holes that are formed for each nozzle N, and the opening portion 812 is an opening that is continuous throughout the plurality of nozzles N. A space that is mutually in communication with an accommodation portion (a concave portion) 852 formed in the housing portion 85, and the opening portion 812 of the flow channel substrate 81, functions as a common liquid chamber (a reservoir) R that retains the ink 15 supplied from the liquid retention portions 14 via an introduction opening 854 of the housing portion 85.

An opening portion 822 is formed in the pressure chamber substrate 82 for each nozzle N. The vibration plate 83 is a flat plate material that is installed on the outer surface of a side of the pressure chamber substrate 82 that is opposite to the flow channel substrate 81 and is capable of elastic deformation. A space that is interposed between the vibration plate 83 and the flow channel substrate 81 on the inner side of each opening portion 822 of the pressure chamber substrate 82, functions as a pressure chamber (cavity) C filled with the ink 15 supplied from the common liquid chamber R via the branched flow channel 814. Each pressure chamber C is in communication with a nozzle N via the communication flow channel 816 of the flow channel substrate 81.

The piezoelectric element 84 is formed for each nozzle N on the outer surface of the vibration plate 83 on a side that is opposite to the pressure chamber substrate 82. Each piezoelectric element 84 is a driving element in which a piezoelectric body is interposed between a pair of electrodes that face one another. When the vibration plate 83 vibrates as a result of the piezoelectric element 84 deforming due to the supply of a driving signal, the pressure inside the pressure chamber C fluctuates, and the ink 15 inside the pressure chamber C is ejected from the nozzle N. Additionally, in the present embodiment, a piezoelectric type head 80 that uses the piezoelectric element 84, which applies mechanical vibrations to the pressure chamber C is illustrated by way of example, but it is also possible to adopt a heat-emitting element that generates air bubbles in an inner portion of a pressure chamber due to heating, as a driving element.

Figure 4:
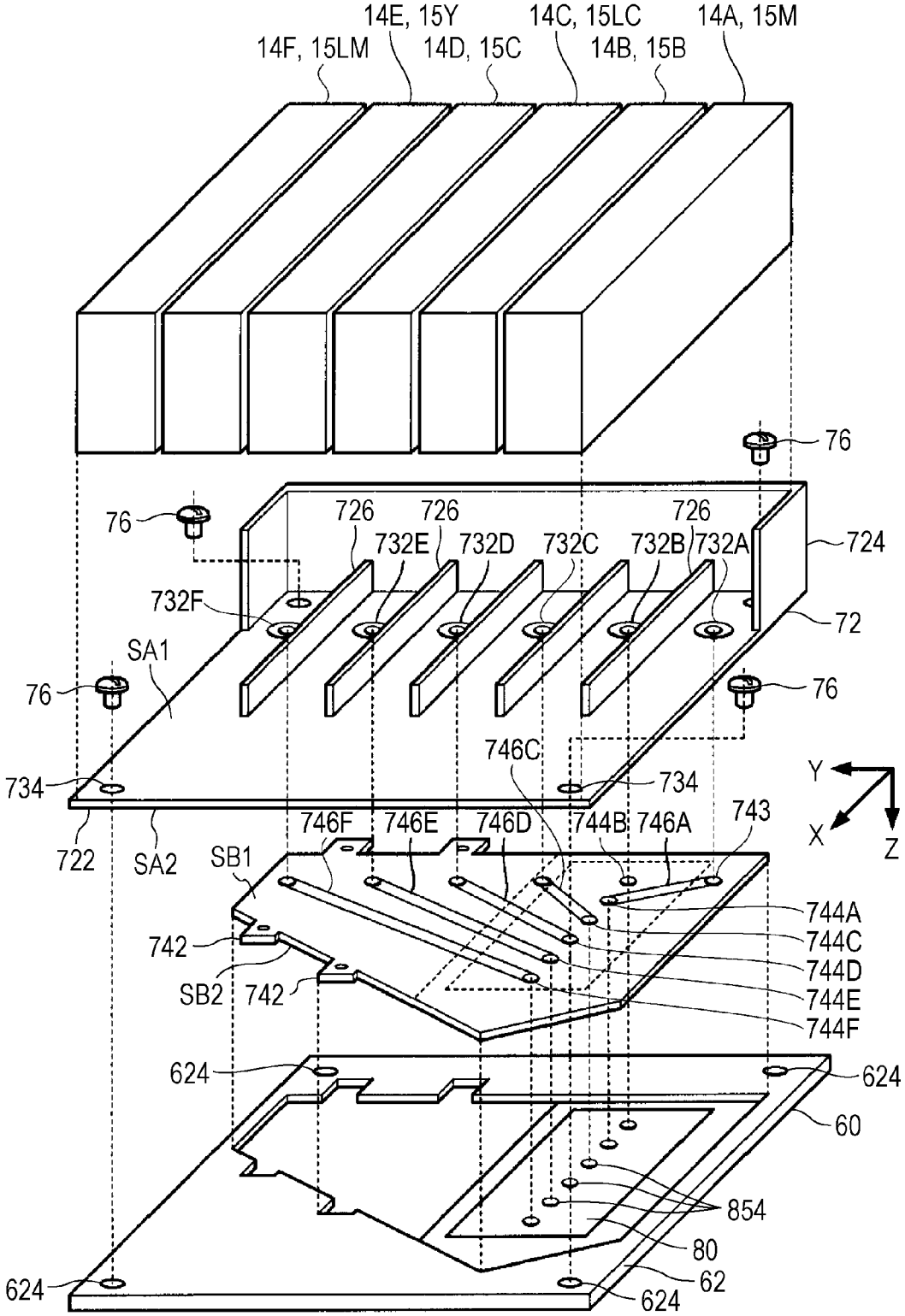
FIG. 4 is an exploded perspective view of a liquid ejecting unit.

FIG. 4 is an exploded perspective view of a liquid ejecting unit.

As shown in FIGS. 2 and 4, the mounting portion 70 includes a main body portion 72 and a sealing portion 74. For example, the main body portion 72 and the sealing portion 74 are mutually formed in an individual manner using injection molding of a resin material.

The main body portion 72 is a structural body in which the plurality of liquid retention portions 14 are mounted, and includes a base portion 722, a side wall portion 724, and a plurality of dividing wall portions 726. The base portion 722 is a substantially flat plate form section that includes an outer surface (hereinafter, referred to as a "mounting surface") SA1 onto which the plurality of liquid retention portions 14 are mounted, and an outer surface (hereinafter, referred to as a "fixing surface") SA2 on a side opposite to the mounting surface SA1. The side wall portion 724 is a wall form section that projects along the peripheral edge of the base portion 722 from the mounting surface SA1. The plurality of dividing wall portions 726 are dividing walls that project from the mounting surface SA1 of the base portion 722 in a manner that partitions spaces in which each liquid retention portion 14 is mounted.

A plurality of introduction openings 732A, 732B, 732C, 732D, 732E, and 732F (referred to simply as introduction openings 732 in some cases from this point onwards), which correspond to the different liquid retention portions 14, are formed in the base portion 722. The plurality of liquid retention portions 14 are mounted and held on the mounting surface SA1 in a manner in which discharge openings (not illustrated in the drawings) of the ink 15 the liquid retention portions 14 are in communication with the introduction openings 732. The ink 15 discharged from the discharge openings of the liquid retention portion 14 is introduced into the introduction openings 732 of the base portion 722.

A plurality of through holes 734, through which screws 76 for fixing the main body portion 72 to the support body 60 are inserted, are formed in each corner portion (the four corners) of the base portion 722 of the mounting portion 70.

Furthermore, through holes 624, through which the screws 76 are inserted, are formed in each corner portion (the four corners) of the bottom surface portion 62 of the support body 60.

The mounting portion 70 is fixed to the support body 60 as a result of four of the screws 76 being inserted into each through hole 734 of the base portion 722 of the mounting portion 70 and each through hole 624 formed in the corner portions of the bottom surface portion 62 of the support body 60.

Additionally, the structure (the connection portions) for mutually fixing the mounting portion 70 and the support body 60 is not limited to the above-mentioned illustrative example. For example, it is also possible to adopt a configuration in which the mounting portion 70 is fixed to the support body 60 using an adhesive, or a configuration in which the mounting portion 70 is fixed to the support body 60 by causing deformation (for example, thermal caulking) after inserting caulking pins formed in one of the mounting portion 70 and the support body 60 into the other.

The sealing portion 74 is a substantially flat plate form member that includes an outer surface (hereinafter, referred to as a "flow channel surface") SB1 facing the base portion 722 of the main body portion 72, and an outer surface (hereinafter, referred to as an "exterior outer surface") SB2 on a side opposite to the flow channel surface SB1. The sealing portion 74 is fixed to the base portion 722 in a state in which the flow channel surface SB1 of the sealing portion 74 is adhered to the fixing surface SA2 of the base portion 722. A plurality of attachment portions 742 are formed on the outer peripheral surface of the sealing portion 74.

The sealing portion 74 is fixed to the main body portion 72 (the base portion 722) using an arbitrary fixing method such as thermal caulking that causes thermal deformation in a state in which the projections of the fixing surface SA2 are inserted into the through holes formed in each attachment portion 742, or screwing by using screws inserted into the through holes of the attachment portions 742.

As shown in FIG. 4, a plurality of introduction openings 743, a plurality of groove portions 746A, 746C, 746D, 746E, and 746F (referred to simply as groove portions 746 in some cases from this point onwards), and a plurality of communication openings 744A, 744B, 744C, 744D, 744E, and 744F (referred to simply as communication openings 744 in some cases from this point onwards) are formed on the flow channel surface SB1 of the sealing portion 74.

The introduction openings 743 are circular indentations that are in communication with the introduction openings 732 of the base portion 722. The groove portions 746 are linear (straight line form or curved line form) indentations that link the introduction openings 743 and the communication openings 744. The communication openings 744 are through holes that pass through the sealing portion 74, and are supply openings of the ink 15 that supply the ink 15 to the introduction openings 854 of the head 80.

As shown in FIG. 2, in a state in which the sealing portion 74 is fixed to the main body portion 72, six flow channels 7A, 7B, 7C, 7D, 7E, and 7F (simply referred to as flow channels 7 in some cases from this point onwards) through which the ink 15 flows, are formed in portions surrounded by the flow channel surface SB1 of the sealing portion 74 and the fixing surface SA2 of the base portion 722. That is, the flow channels 7 are flow channels of the ink 15 that are provided in the mounting portion 70 and supply the ink 15 to the head 80 from the liquid retention portions 14.

The flow channel 7A is a flow channel of the ink 15M that supplies the ink 15M to the head 80 from the liquid retention portion 14A. The flow channel 7B is a flow channel of the ink 15B that supplies the ink 15B to the head 80 from the liquid retention portion 14B. The flow channel 7C is a flow channel of the ink 15LC that supplies the ink 15LC to the head 80 from the liquid retention portion 14C. The flow channel 7D is a flow channel of the ink 15C that supplies the ink 15C to the head 80 from the liquid retention portion 14D. The flow channel 7E is a flow channel of the ink 15Y that supplies the ink 15Y to the head 80 from the liquid retention portion 14E. The flow channel 7F is a flow channel of the ink 15LM that supplies the ink 15LM to the head 80 from the liquid retention portion 14F.

In the present embodiment, at least a portion of the liquid retention portion 14B is disposed so as to overlap with the head 80 when viewed in a planar manner so that the discharge opening of the ink 15B in the liquid retention portion 14B, the introduction opening 732B, the communication opening 744B, and the corresponding introduction opening 854 of the head 80 overlap when viewed in a planar manner.

As a result of this, the ink 15B retained in the liquid retention portion 14B is supplied to the head 80 via the discharge opening of the ink 15B in the liquid retention portion 14B, the introduction opening 732B and the communication opening 744B of the mounting portion 70, and the introduction opening 854 of the head 80. Further, the flow channel 7B provided in the mounting portion 70 is configured to include the introduction opening 732B and the communication opening 744B but does not include an introduction opening 743 and a groove portion 746.

On the other hand, at least a portion of each of the liquid retention portions 14A, 14C, 14D, 14E, and 14F is disposed so as to not overlap with the head 80 when viewed in a planar manner. Further, the discharge openings of the types of ink 15M, 15LC, 15C, 15Y, and 15LM of the liquid retention portions 14A, 14C, 14D, 14E, and 14F, the communication openings 744A, 744C, 744D, 744E, and 744F, and the corresponding introduction openings 854 of the head 80 are disposed so as to not overlap with one another when viewed in a planar manner.

As a result of this, the ink 15M retained in the liquid retention portion 14A is supplied to an introduction opening 854 of the head 80 via the discharge opening of the ink 15M in the liquid retention portion 14A, the introduction opening 732A, an introduction opening 743, the groove portion 746A, and the communication opening 744A of the mounting portion 70. Further, the flow channel 7A provided in the mounting portion 70 is configured to include the introduction opening 732A, an introduction opening 743, the groove portion 746A and the communication opening 744A.

The ink 15LC retained in the liquid retention portion 14C is supplied to an introduction opening 854 of the head 80 via the discharge opening of the ink 15LC in the liquid retention portion 14C, the introduction opening 732C, an introduction opening 743, the groove portion 746C, and the communication opening 744C of the mounting portion 70. Further, the flow channel 7C provided in the mounting portion 70 is configured to include the introduction opening 732C, an introduction opening 743, the groove portion 746C and the communication opening 744C.

The ink 15C retained in the liquid retention portion 14D is supplied to an introduction opening 854 of the head 80 via the discharge opening of the ink 15C in the liquid retention portion 14D, the introduction opening 732D, an introduction opening 743, the groove portion 746D, and the communication opening 744D of the mounting portion 70. Further, the flow channel 7D provided in the mounting portion 70 is configured to include the introduction opening 732D, an introduction opening 743, the groove portion 746D and the communication opening 744D.

The ink 15Y retained in the liquid retention portion 14E is supplied to an introduction opening 854 of the head 80 via the discharge opening of the ink 15Y in the liquid retention portion 14E, the introduction opening 732E, an introduction opening 743, the groove portion 746E, and the communication opening 744E of the mounting portion 70. Further, the flow channel 7E provided in the mounting portion 70 is configured to include the introduction opening 732E, an introduction opening 743, the groove portion 746E and the communication opening 744E.

The ink 15LM retained in the liquid retention portion 14F is supplied to an introduction opening 854 of the head 80 via the discharge opening of the ink 15LM in the liquid retention portion 14F, the introduction opening 732F, an introduction opening 743, the groove portion 746F, and the communication opening 744F of the mounting portion 70. Further, the flow channel 7F provided in the mounting portion 70 is configured to include the introduction opening 732F, an introduction opening 743, the groove portion 746F and the communication opening 744F.

Since the flow channel 7B provided in the mounting portion 70 does not include an introduction opening 743 and a groove portion 746 and the flow channels 7A, 7C, 7D, 7E, and 7F provided in the mounting portion 70 include an introduction opening 743 and a groove portion 746, the flow channel length of the flow channel 7B is the shortest among the flow channel lengths of the plurality of flow channels 7A, 7B, 7C, 7D, 7E, and 7F.

That is, the present embodiment has a configuration in which the flow channel length of the flow channel 7B that supplies the black (B) ink 15B is the shortest among the flow channel lengths of the plurality of flow channels 7A, 7B, 7C, 7D, 7E, and 7F.

In the above-mentioned manner, since the consumption amount of the black (B) ink 15B is the greatest, the present embodiment has a configuration in which, among the flow channel lengths of the plurality of flow channels 7A, 7B, 7C, 7D, 7E, and 7F, the flow channel length of the flow channel 7B that supplies the black (B) ink 15B having the greatest consumption amount among the types of ink 15M, 15B, 15LC, 15C, 15Y, and 15LM retained in the plurality of liquid retention portions 14A, 14B, 14C, 14D, 14E, and 14F is the shortest.

Furthermore, the flow channel lengths of the flow channels 7A, 7C, 7D, 7E, and 7F depend on the lengths of the groove portions 746A, 746C, 746D, 746E, and 746F. In the present embodiment, since the groove portions increase in length in the order of the groove portion 746C, the groove portion 746A, the groove portion 746D, the groove portion 746E, and the groove portion 746F, the flow channel lengths increase in the order of the flow channel 7C, the flow channel 7A, the flow channel 7D, the flow channel 7E, and the flow channel 7F.

That is, in the present embodiment, the flow channel lengths increase in the order of the flow channel 7B, the flow channel 7C, the flow channel 7A, the flow channel 7D, the flow channel 7E, and the flow channel 7F.

Since the consumption amount of the ink 15B is greater than those of the other types of ink 15C, 15M, 15Y, 15LC, and 15LM, the number of times that the ink 15B is ejected (referred to as the frequency of use from this point onwards) in the head 80 is the greatest. That is, in the liquid ejecting unit 40, the frequency of use of the ink 15B is the highest.

If the frequency of use of an ink 15 in the liquid ejecting unit 40 is high, in comparison with a case in which the frequency of use of an ink 15 is low, it is likely that air bubbles will occur in the flow channel of the ink 15 that runs from a liquid retention portion 14 to a nozzle N of the head 80.

In the liquid ejecting apparatus 1, air bubbles that occur in a flow channel of an ink 15 that runs from a liquid retention portion 14 to a nozzle N of the head 80 are forcibly discharged to an outer portion from the nozzle N by carrying out a maintenance process (for example, a flushing process) at regular intervals.

If air bubbles remain in a flow channel of an ink 15 that runs from a liquid retention portion 14 to a nozzle N of the head 80, the ink 15 is not ejected properly from the nozzle N, and a defect in which a dot to be formed by the ink 15 is not formed occurs (dot omission).

Since the frequency of use of the black (B) ink 15B is the highest, it is most likely that air bubbles will occur in the flow channel of the ink 15B that runs from a liquid retention portion 14 to a nozzle N of the head 80.

Furthermore, since it is easier to visually recognize dots formed by the black (B) ink 15B than dots formed by the other types of ink 15C, 15M, 15Y, 15LC, and 15LM, dot omission of the ink 15B stands out more than dot omission of the other types of ink 15C, 15M, 15Y, 15LC, and 15LM.

Therefore, if a defect (dot omission of the ink 15B) caused by air bubbles occurs in the black (B) ink 15B, the defect leads to a deterioration in the appearance quality of characters, images, and the like, recorded on the medium 12. On the other hand, if it is unlikely that a defect (dot omission of the ink 15B) caused by air bubbles will occur in the black (B) ink 15B, it is possible to enhance the appearance quality of characters, images, and the like, recorded on the medium 12.

In the present embodiment, since the flow channel length of the flow channel of the ink 15 is shorter than those of the other types of ink 15M, 15LC, 15C, 15Y, and 15LM, in the black (B) ink 15B in which defects stand out the most (the ink 15B having the highest frequency of use), air bubbles occur on a side that is close to a nozzle N. If air bubbles occur on a side that is close to a nozzle N, it is easier to discharge the air bubbles from the nozzle N than in a case in which air bubbles occur on a side that is far from a nozzle N.

Since the flow channel length of the flow channel 7B of the black (B) ink 15B in which defects stand out the most is the shortest, it is unlikely that a defect (dot omission of the ink 15B) will occur as a result of air bubbles in the ink 15B since it is likely that air bubbles will be discharged from the nozzle N due to the air bubbles occurring on a side that is close to the nozzle N.

Furthermore, if the flow channel of the ink 15B inside the liquid ejecting unit 40 is short, the flow channel resistance in the flow channel of the ink 15B is low, and therefore, it is likely that the ink 15B will be ejected from a nozzle N in comparison with a case in which the flow channel resistance is high. Accordingly, it is unlikely that a defect (dot omission of the ink 15B) will occur as a result of the flow channel resistance of the ink 15B being high.

In this manner, as a result of making the flow channel length of the flow channel 7B of the black (B) ink 15B in which defects stand out the most (the ink 15B having the highest frequency of use) the shortest, it is unlikely that a defect (dot omission of the ink 15B) caused by air bubbles in the ink 15B or a defect (dot omission of the ink 15B) will occur as a result of the flow channel resistance of the ink 15B being high, and therefore, it is possible to enhance the appearance quality of characters, images, and the like recorded on the medium 12.

Embodiment 2

Figure 5:
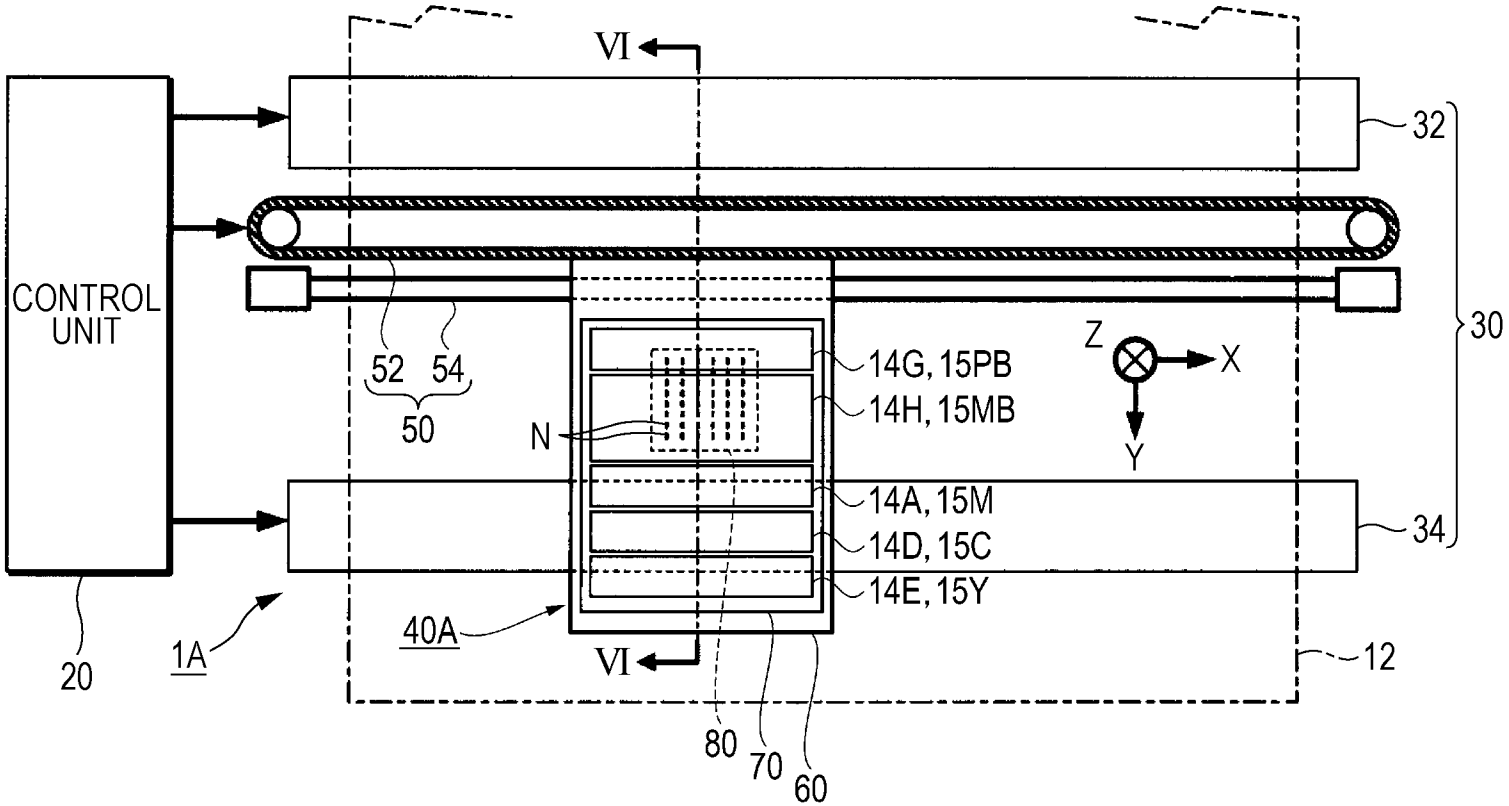
FIG. 5 is a configuration view of a liquid ejecting apparatus according to Embodiment 2.
Figure 6:
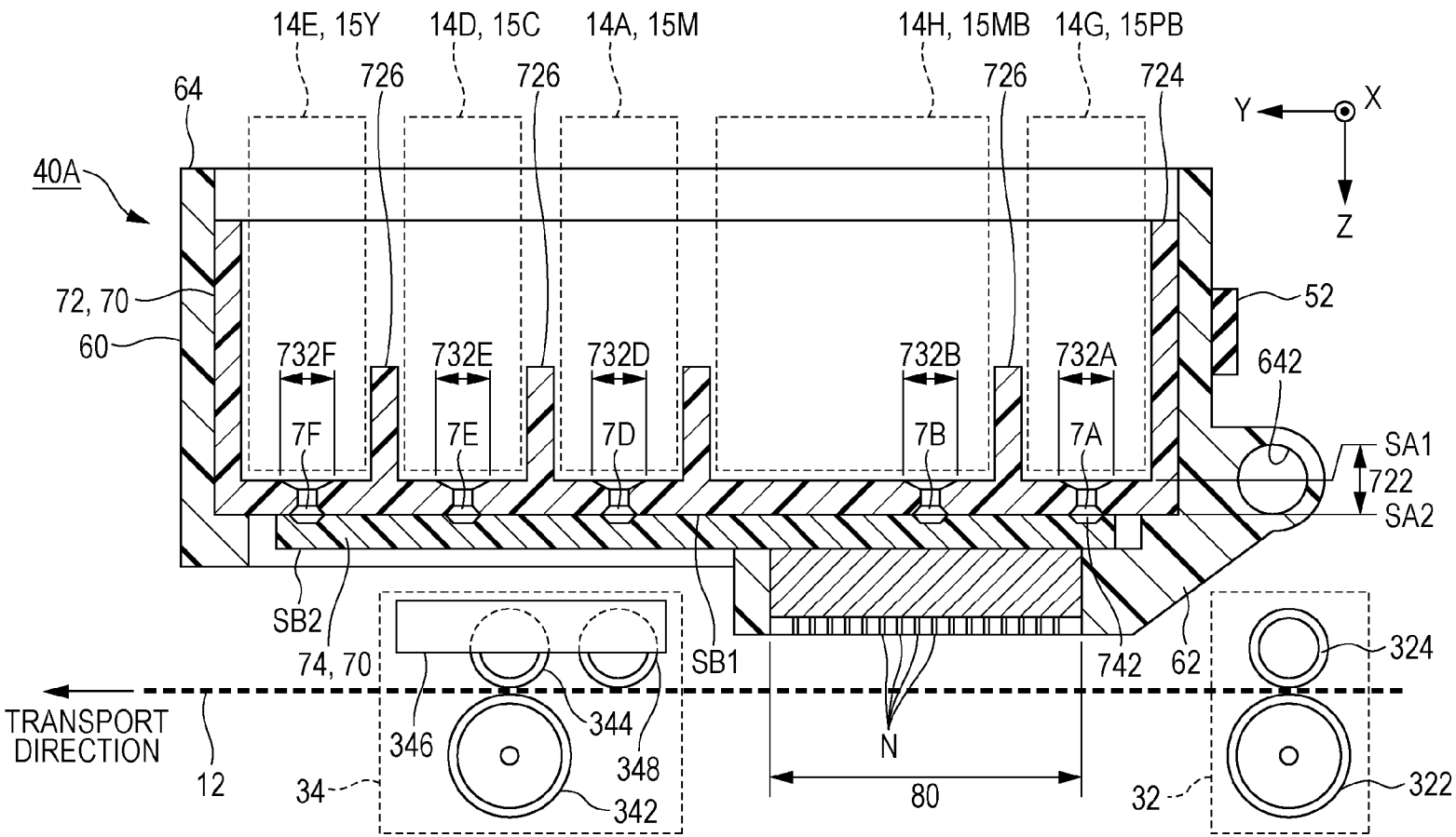
FIG. 6 is a cross-sectional view along a line VI-VI in FIG. 5.
Figure 7:
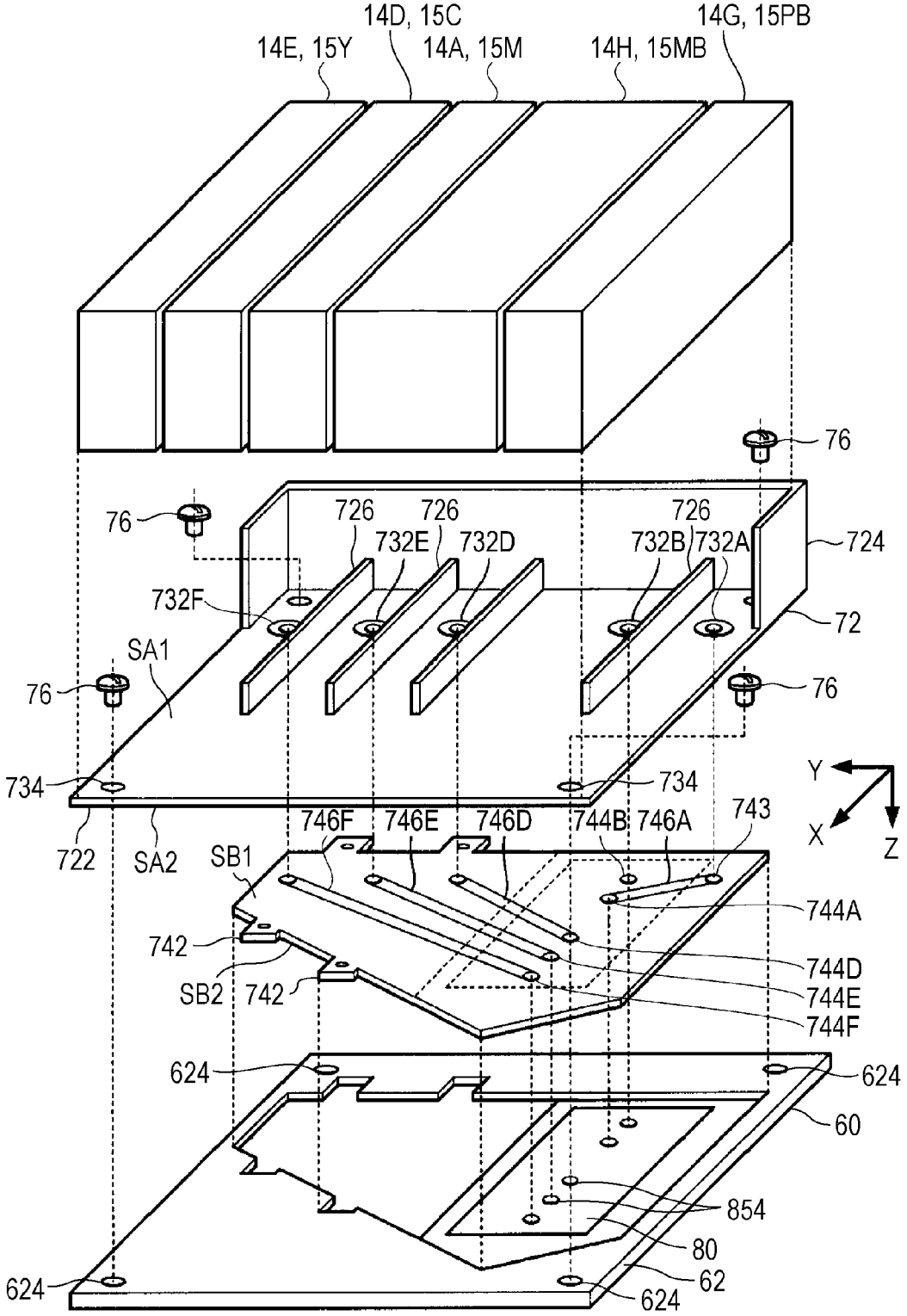
FIG. 7 is an exploded perspective view of a liquid ejecting unit.

FIG. 5 is a view that corresponds to FIG. 1, and is a configuration view of a liquid ejecting apparatus according to Embodiment 2. FIG. 6 is a view that corresponds to FIG. 2, and is cross-sectional view along a line VI-VI in FIG. 5. FIG. 7 is a view that corresponds to FIG. 4, and is an exploded perspective view of a liquid ejecting unit.

Hereinafter, an outline of a liquid ejecting apparatus 1A according to the present embodiment will be described focusing on the differences from Embodiment 1 with reference to FIGS. 5 to 7. In addition, constituent sites that are the same as those of Embodiment 1 will be given the same reference numerals, and overlapping descriptions thereof will be omitted.

As shown in FIG. 5, five types (five colors) of ink 15 are used by the present embodiment and this is a difference from Embodiment 1. To explain in more detail, the ink 15 used in the present embodiment is configured by a photo black (PB) ink 15PB, a matte black (MB) ink 15MB, a cyan (C) ink 15C, a magenta (M) ink 15M, and a yellow (Y) ink 15Y.

The photo black (PB) ink 15PB includes a black dye as a color material. The matte black (MB) ink 15MB includes a black pigment as a color material. The matte black (MB) ink 15MB can reproduce a more complete black than the photo black (PB) ink 15PB. In comparison with the matte black (MB) ink 15MB, the photo black (PB) ink 15PB can reproduce a variety of concentrations (reflectances) of black such as grey, for example.

In the liquid ejecting apparatus 1A, the reproduction of a more complete black is required, and therefore, the consumption amount of the matte black (MB) ink 15MB is the greatest. That is, the matte black (MB) ink 15MB is an example of "a liquid having the greatest consumption amount".

A liquid retention portion 14G in which the magenta photo black (PB) ink 15PB is retained, a liquid retention portion 14H in which the matte black (MB) ink 15MB is retained, a liquid retention portion 14A in which the magenta (M) ink 15M is retained, a liquid retention portion 14D in which the cyan (C) ink 15C is retained, and a liquid retention portion 14E in which the yellow (Y) ink 15Y is retained are mounted in a mounting portion 70, arranged along a Y direction. Each of the liquid retention portions 14G, 14H, 14A, 14D, and 14E can be attached and detached to and from the mounting portion 70 in an individual manner.

The retention capacities of the ink 15 in the liquid retention portions 14G, 14A, 14D, and 14E are all the same, and are the same retention capacity as that of Embodiment 1. The retention capacity of the ink 15MB in the liquid retention portion 14H is greater than the retention capacity of the ink 15 of the liquid retention portions 14G, 14A, 14D, and 14E, and is twice the retention capacity of the ink 15 of the liquid retention portions 14G, 14A, 14D, and 14E. This feature is a difference from Embodiment 1.

That is, the liquid retention portion 14H is an example of "a liquid retention portion having the greatest retention capacity".

In a state in which a sealing portion 74 is fixed to a main body portion 72, five flow channels 7A, 7B, 7D, 7E, and 7F (simply referred to as flow channels 7 in some cases from this point onwards) through which the ink 15 flows, are formed in portions surrounded by a flow channel surface SB1 of the sealing portion 74 and a fixing surface SA2 of a base portion 722.

In a state in which the sealing portion 74 is fixed to the main body portion 72, five flow channels 7A, 7B, 7D, 7E, and 7F are formed in the present embodiment, and six flow channels 7A, 7B, 7C, 7D, 7E, and 7F are formed in Embodiment 1. This feature is a difference between the present embodiment and Embodiment 1. In other words, the flow channel 7 according to the present embodiment has a configuration in which the flow channel 7C has been omitted from the flow channels 7 according to Embodiment 1.

The flow channel 7A is a flow channel of the ink 15PB that supplies the ink 15PB to a head 80 from the liquid retention portion 14G. The flow channel 7B is a flow channel of the ink 15MB that supplies the ink 15MB to the head 80 from the liquid retention portion 14H. The flow channel 7D is a flow channel of the ink 15M that supplies the ink 15M to the head 80 from the liquid retention portion 14A. The flow channel 7E is a flow channel of the ink 15C that supplies the ink 15C to the head 80 from the liquid retention portion 14D. The flow channel 7F is a flow channel of the ink 15Y that supplies the ink 15Y to the head 80 from the liquid retention portion 14E.

In the present embodiment, among flow channel lengths of the plurality of flow channels 7A, 7B, 7D, 7E, and 7F, a flow channel length of the flow channel 7B that supplies the ink 15MB, which is retained in the liquid retention portion 14H that has the greatest retention capacity is shortest.

In the present embodiment, a discharge opening of the ink 15MB in the liquid retention portion 14H, a communication opening 744B, and a corresponding introduction opening 854 are disposed so as to overlap with one another when viewed in a planar manner so that the flow channel length of the flow channel 7B of the matte black (MB) ink 15MB is the shortest. That is, at least a portion of the liquid retention portion 14H, which has the greatest retention capacity, is disposed so as to overlap with the head 80 when viewed in a planar manner so that the flow channel length of the flow channel 7B of the matte black (MB) ink 15MB is the shortest.

Since it is easier to visually recognize dots formed by the matte black (MB) ink 15MB than dots formed by the other types of ink 15PB, 15M, 15C, and 15Y, dot omission of the ink 15MB stands out more than dot omission of the other types of ink 15PB, 15M, 15C, and 15Y.

Therefore, if it is unlikely that a defect (dot omission of the ink 15MB) caused by air bubbles and a defect (dot omission of the ink 15MB) will occur in the matte black (MB) ink 15MB as a result of the flow channel resistance being high, it is possible to enhance the appearance quality of characters, images, and the like, recorded on the medium 12.

In the present embodiment, since the flow channel length of the flow channel 7B of the matte black (MB) ink 15MB in which defects stand out the most is the shortest, it is unlikely that air bubbles will remain in the flow channel of the ink 15MB that runs from a liquid retention portion 14 to the nozzle N of the head 80, and therefore, it is unlikely that a defect (dot omission of the ink 15MB) will occur as a result of air bubbles in the ink 15MB.

Furthermore, in the present embodiment, since the flow channel length of the flow channel 7B of the matte black (MB) ink 15MB is the shortest and the flow channel resistance of the matte black (MB) ink 15MB is the lowest as a result, it is unlikely that a defect (dot omission of the ink 15MB) will occur as a result of the flow channel resistance of the ink 15MB being high.

Accordingly, as a result of making the flow channel length of the flow channel 7B of the matte black (MB) ink 15MB in which defects stand out the most the shortest, it is unlikely that either one of a defect (dot omission of the ink 15MB) caused by air bubbles in the ink 15MB or a defect (dot omission of the ink 15MB) will occur as a result of the flow channel resistance of the ink 15MB being high, and therefore, it is possible to enhance the appearance quality of characters, images, and the like recorded on the medium 12.

Embodiment 3

Figure 8:
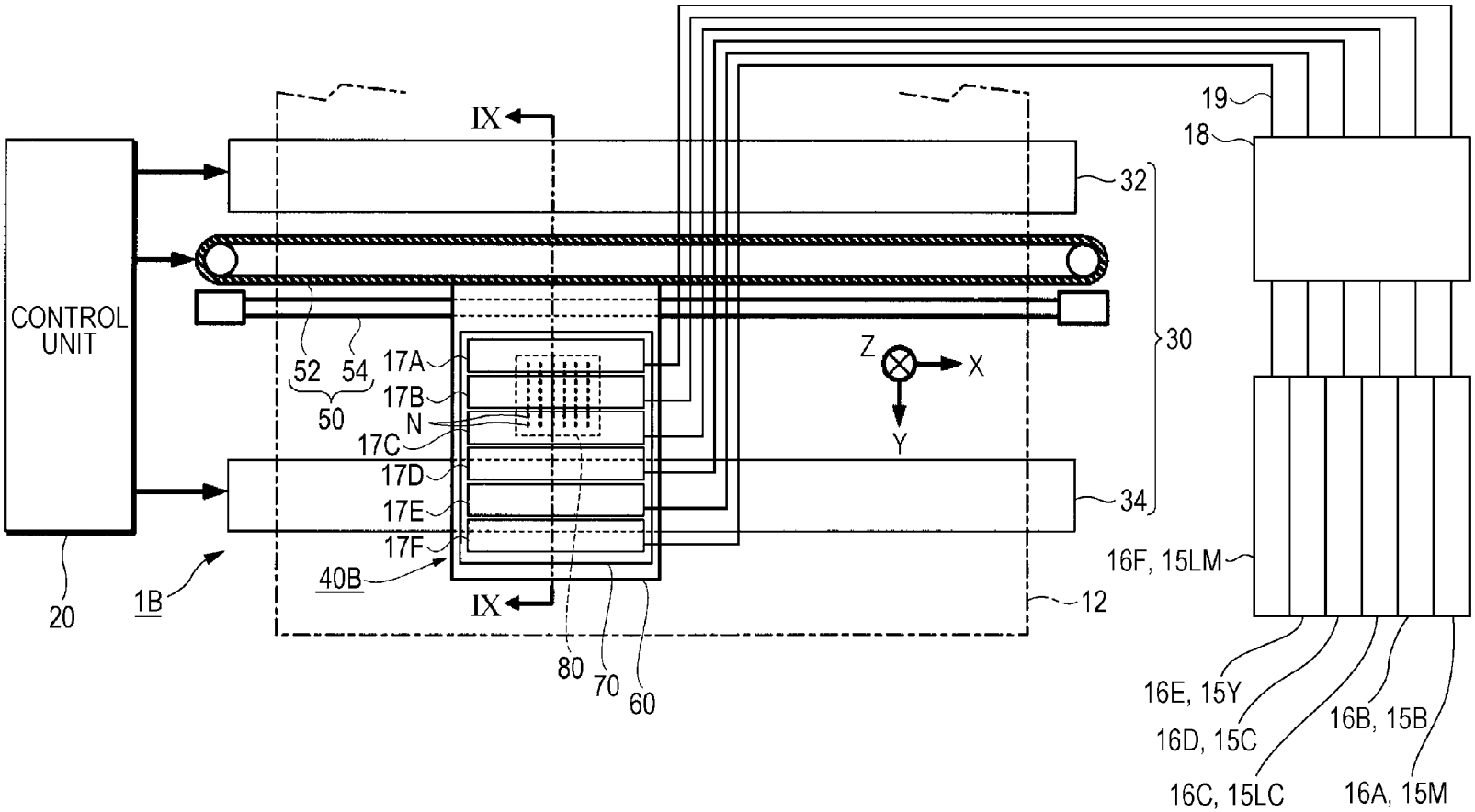
FIG. 8 is a configuration view of a liquid ejecting apparatus according to Embodiment 3.
Figure 9:
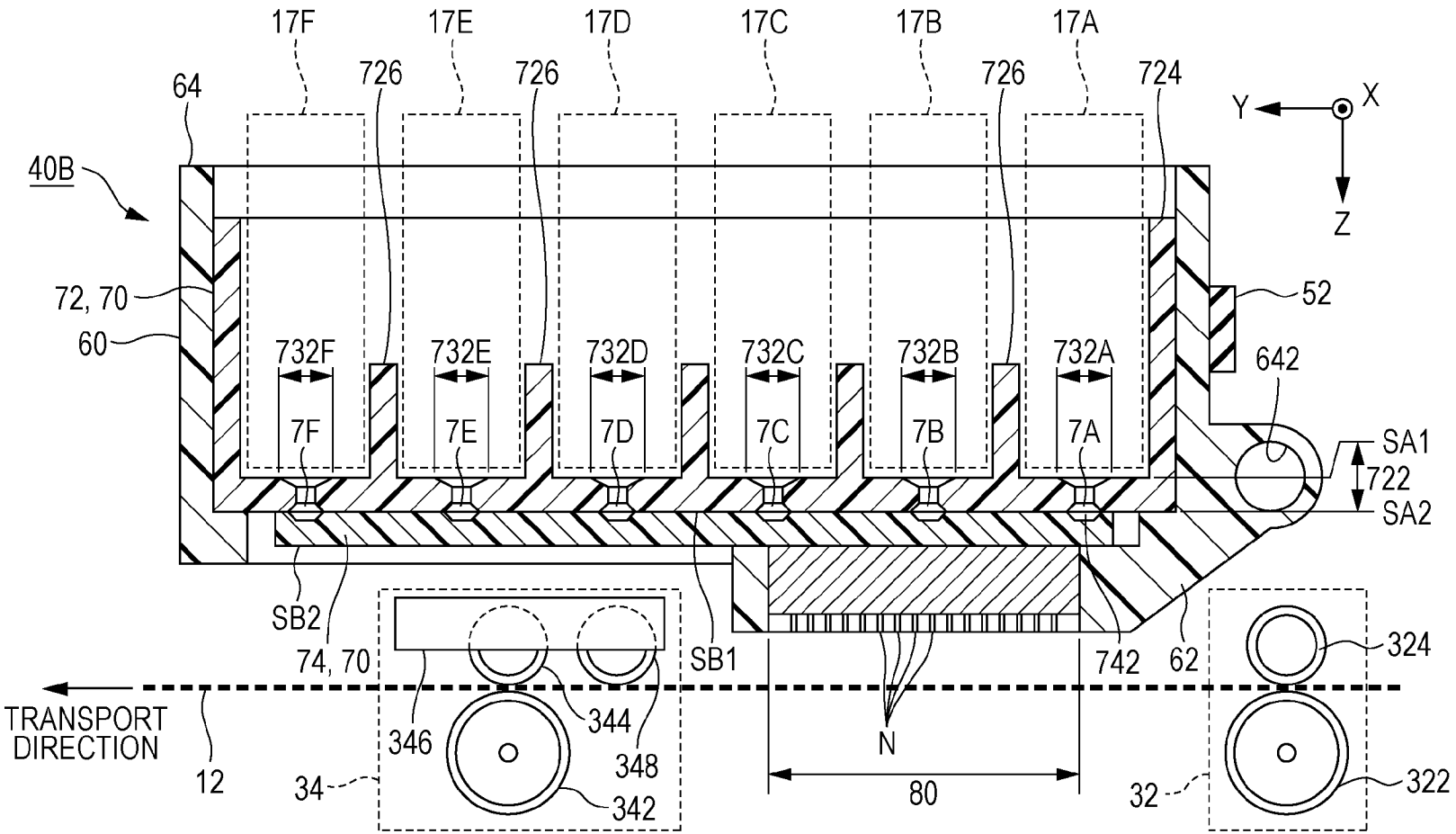
FIG. 9 is a cross-sectional view along a line IX-IX in FIG. 8.
Figure 10:
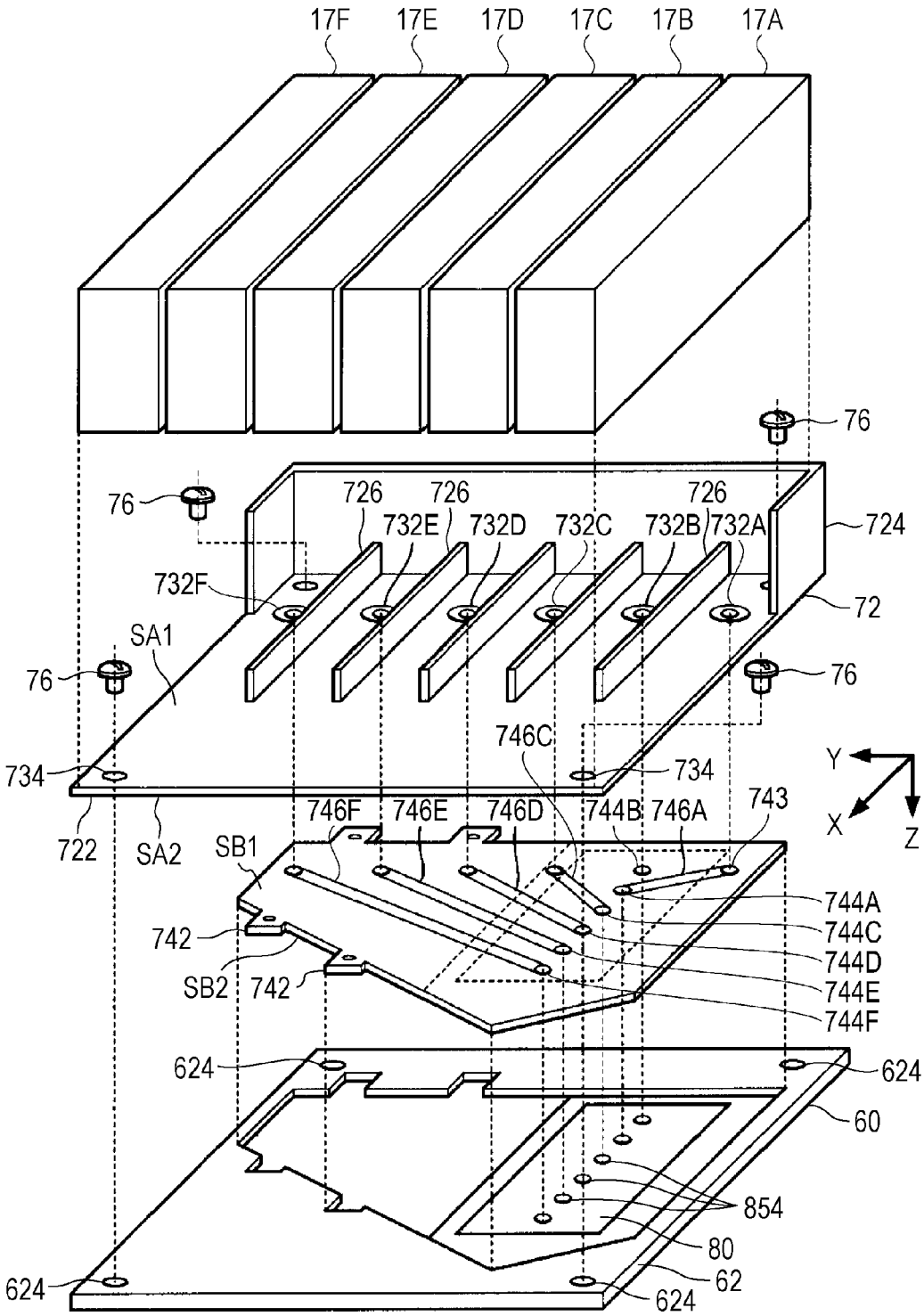
FIG. 10 is an exploded perspective view of a liquid ejecting unit.
Figure 11:
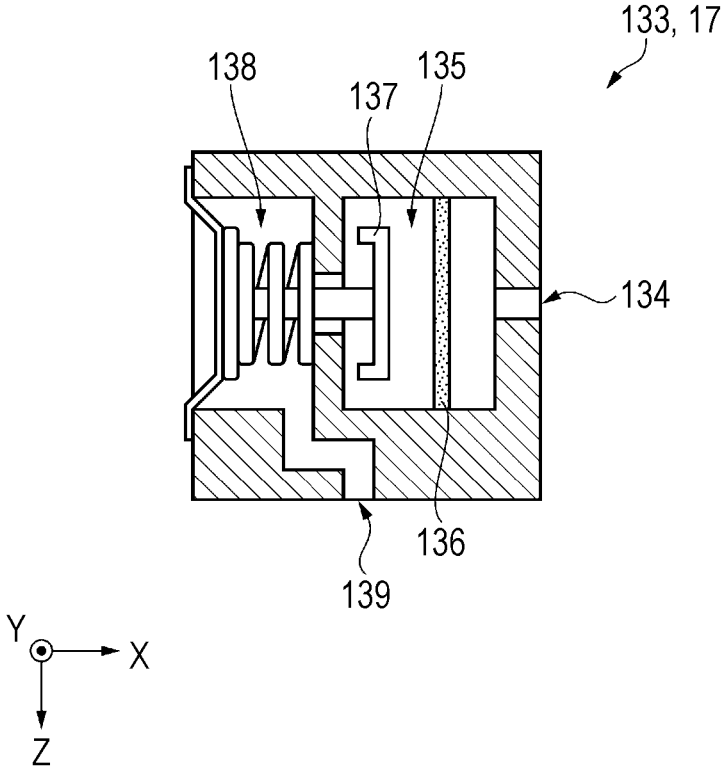
FIG. 11 is a schematic view of the main components of a valve unit.

FIG. 8 is a view that corresponds to FIG. 1, and is a configuration view of a liquid ejecting apparatus according to Embodiment 3. FIG. 9 is a view that corresponds to FIG. 2, and is cross-sectional view along a line IX-IX in FIG. 8. FIG. 10 is a view that corresponds to FIG. 4, and is an exploded perspective view of a liquid ejecting unit. FIG. 11 is a schematic view of the main components of a valve unit. That is, FIG. 11 is a schematic view of a flow pressure adjustment portion 133 built into a valve unit 17.

Hereinafter, an outline of a liquid ejecting apparatus 1B according to the present embodiment will be described focusing on the differences from Embodiment 1 with reference to FIGS. 8 to 11. In addition, constituent sites that are the same as those of Embodiment 1 will be given the same reference numerals, and overlapping descriptions thereof will be omitted.

As shown in FIG. 8, the liquid ejecting apparatus 1B according to the present embodiment is an off-carriage type printing apparatus in which ink tanks 16A, 16B, 16C, 16D, 16E, and 16F (simply referred to as ink tanks 16 in some cases from this point onwards), in which types of ink 15M, 15B, 15LC, 15C, 15Y, and 15LM are retained, are disposed in locations that are separate from a support body 60 (a carriage). On the other hand, the liquid ejecting apparatus 1 according to Embodiment 1 is an on-carriage type printing apparatus in which the liquid retention portions 14, in which the ink 15 is retained, are disposed in the support body 60 (a carriage).

This feature is a difference between the present embodiment and Embodiment 1.

Magenta (M) ink 15M is retained in the ink tank 16A, black (B) ink 15B is retained in the ink tank 16B, light cyan (LC) ink 15LC is retained in the ink tank 16C, cyan (C) ink 15C is retained in the ink tank 16D, yellow (Y) ink 15Y is retained in the ink tank 16E, and light magenta (LM) ink 15LM is retained in the ink tank 16F.

The six types (six colors) of the ink 15 retained in the ink tanks 16 are respectively pressurized by a pressurization portion 18, and are supplied to a head 80 via six ink supply tubes 19, and six valve units 17A, 17B, 17C, 17D, 17E, and 17F (referred to as valve units 17 in some cases from this point onwards).

A feature of the valve units 17 being disposed on an upstream side in a flow direction of the ink 15 with respect to the head 80 is a difference between the present embodiment and Embodiment 1.

The valve units 17 adjust the flow pressure of the ink 15 supplied to the head 80 so that the ink 15 is ejected stably from the nozzles N of the head 80. That is, the flow pressure of the ink 15 supplied to the head 80 is adjusted by flow pressure adjustment portions 133 provided in flow channels (referred to as liquid flow channels from this point onwards) of the ink 15 inside the valve units 17.

In the present embodiment, a single flow pressure adjustment portion 133 is built-into each valve unit 17 so that it is possible to adjust the flow pressure of the ink 15 of a single color by using a valve unit 17. Therefore, the valve units 17 are respectively connected to six ink supply tubes 19.

Additionally, the valve units 17 may also have a configuration that includes a plurality of flow pressure adjustment portions 133 that adjust the flow pressure of a plurality of colors of the ink 15.

The flow pressure adjustment portions 133 include an ink introduction channel 134, an ink supply chamber 135 in which the ink 15 is retained, a filter 136 provided inside the ink supply chamber 135, a valve body 137, a pressure chamber 138 in which the ink 15 is retained, and an ink lead-through channel 139. The ink 15 supplied in a pressurized manner by the pressurization portion 18 is supplied to the head 80 as a result of passing through the ink introduction channel 134, the ink supply chamber 135, the valve body 137, the pressure chamber 138, and the ink lead-through channel 139.

In this manner, the valve units 17, in which the ink 15 is retained in the inner portion (the flow pressure adjustment portions 133) thereof, are an example of "a liquid retention portion".

The ink 15 is supplied to the ink supply chamber 135 in a pressurized state. The valve body 137 is disposed between the ink supply chamber 135 and the pressure chamber 138, and opens and closes a liquid flow channel between the ink supply chamber 135 and the pressure chamber 138. The ink supply chamber 135 is disposed on an upstream side of the liquid flow channel with respect to the valve body 137, and the pressure chamber 138 is disposed on the downstream side of the liquid flow channel with respect to the valve body 137.

During a printing operation, the pressure chamber 138 is sequentially replenished with the ink 15 from the ink supply chamber 135 while the valve body 137 opens slightly in accordance with consumption of ink 15. Furthermore, pressure fluctuations in the ink 15 inside the ink supply chamber 135 on the upstream side of the liquid flow channel are isolated from pressure changes of the ink 15 inside the pressure chamber 138 on the downstream side of the liquid flow channel as a result of being restricted to be within a given predetermined range due to opening and closing of the valve body 137. Accordingly, even if a pressure change occurs further on the upstream side of the liquid flow channel than the valve body 137, the downstream side of the liquid flow channel is not subjected to the effects thereof. Therefore, the flow pressure of the ink 15 supplied to the head 80 is adjusted as a result of the pressure that acts on the ink 15 inside the pressure chamber 138 of the flow pressure adjustment portion 133 (the valve unit 17) being controlled to be in a predetermined range.

To explain in more detail, the valve units 17 adjust the pressure of the ink 15 supplied to the head 80 so that negative pressure is applied to the ink supplied to the nozzles N in order for the ink to be ejected properly from the nozzles N during printing without the ink 15 leaking out from the nozzles N of the head 80 during non-printing.

The ink 15M is supplied to a corresponding introduction opening 854 of the head 80 via the valve unit 17A and the flow channel 7A. The ink 15B is supplied to a corresponding introduction opening 854 of the head 80 via the valve unit 17B and the flow channel 7B. The ink 15LC is supplied to a corresponding introduction opening 854 of the head 80 via the valve unit 17C and the flow channel 7C. The ink 15C is supplied to a corresponding introduction opening 854 of the head 80 via the valve unit 17D and the flow channel 7D. The ink 15Y is supplied to a corresponding introduction opening 854 of the head 80 via the valve unit 17E and the flow channel 7E. The ink 15LM is supplied to a corresponding introduction opening 854 of the head 80 via the valve unit 17F and the flow channel 7F.

The present embodiment has a configuration in which the flow channel length of the flow channel 7B of the black (B) ink 15B in which defects stand out the most is the shortest.

As a result of making the flow channel length of the flow channel 7B of the black (B) ink 15B in which defects stand out the most the shortest, it is unlikely that air bubbles will remain in the flow channel of the ink 15B that runs from the valve unit 17 to the nozzle N of the head 80, and therefore, it is unlikely that a defect (dot omission of the ink 15B) caused by air bubbles in the ink 15B.

Furthermore, the flow channel resistance of the black (B) ink 15B is the lowest, and therefore, it is unlikely that a defect (dot omission of the ink 15B) will occur as a result of the flow channel resistance of the ink 15B being high.

Accordingly, as a result of making the flow channel length of the flow channel 7B of the black (B) ink 15B in which defects stand out the most the shortest, it is unlikely that either one of a defect (dot omission of the ink 15B) caused by air bubbles in the ink 15B or a defect (dot omission of the ink 15B) will occur as a result of the flow channel resistance of the ink 15B being high, and therefore, it is possible to enhance the appearance quality of characters, images, and the like recorded on the medium 12.

The present invention is not limited to the abovementioned embodiments, can be changed as appropriate within a range that does not depart from the scope or the idea of the invention that can be understood from the claims and the entirety of the specification, and it is possible to consider various modification examples in addition to the above-mentioned embodiments. Hereinafter, modification examples will be described.

Modification Example 1

It is more likely that a defect such as dot omission will occur in an ink having a high frequency of use (an ink for which there are a large number of repetitions of being ejected from a head) than in an ink having a low frequency of use (an ink for which there are a small number of repetitions of being ejected from the head). Furthermore, it is important for it to be more unlikely for a dot defect to occur in an ink for which it is likely that a dot defect will stand out than in an ink for which it is unlikely that a dot defect will stand out. Therefore, it is preferable that the flow channel length of a flow channel that supplies an ink having a high frequency of use and an ink for which it is likely that a dot defect will stand out be short.

For example, in a case in which there is a difference in the frequency of use and the likelihood that defects will stand out in the inks that are used in a liquid ejecting apparatus, it is preferable that ink having a high frequency of use and ink for which it is likely that defects will stand out be supplied via flow channels for which the flow channel length is short, and that ink having a low frequency of use and ink for which it is unlikely that defects will stand out be supplied via flow channels for which the flow channel length is long.

For example, in Embodiment 1, the flow channel lengths increase in the order of the flow channel 7B, the flow channel 7C, the flow channel 7A, the flow channel 7D, the flow channel 7E, and the flow channel 7F. In the above-mentioned manner, it is preferable that the ink 15 having the highest frequency of use (the ink 15B) be supplied via the flow channel 7B for which the flow channel length is the shortest. It is preferable that the ink 15 having the next highest frequency of use be supplied via the flow channel 7C for which the flow channel length is the next shortest. It is preferable that the ink 15 having the next highest frequency of use be supplied via the flow channel 7A for which the flow channel length is the next shortest. It is preferable that the ink 15 having the next highest frequency of use be supplied via the flow channel 7D for which the flow channel length is the next shortest. It is preferable that the ink 15 having the next highest frequency of use be supplied via the flow channel 7E for which the flow channel length is the next shortest. Further, it is preferable that the ink 15 having the lowest frequency of use be supplied via the flow channel 7F for which the flow channel length is the longest, that is, it is preferable that the flow channels that supply the ink be selected depending on the frequency of use and the likelihood that defects will stand out.

Modification Example 2

In addition to machines that are dedicated to printing, a similar configuration to that of the liquid ejecting apparatuses 1, 1A, and 1B illustrated by way of example in the above-mentioned embodiments can be applied to various machines such as facsimile apparatuses and copy machines.

Furthermore, the applications of the liquid ejecting apparatus of the invention are not limited to printing. For example, a liquid ejecting apparatus that ejects a solution of a color material can be used as a manufacturing apparatus that forms color filters of a liquid crystal display apparatus. In addition, a liquid ejecting apparatus that ejects a solution of a conductive material can be used as a manufacturing apparatus that forms wiring substrates and electrodes.

What is claimed is:

1. A liquid ejecting apparatus comprising:

a head comprising a plurality of introduction openings and a plurality of sets of nozzles, each set of nozzles corresponding to each of the plurality of introduction openings, the head receiving a corresponding liquid from each of at least one of the plurality of introduction openings and ejecting the corresponding liquid through the corresponding set of nozzles while moving in a scanning direction, the plurality of introduction openings being arranged in a direction parallel to the scanning direction;

a plurality of liquid retention portions that are arranged in a direction that intersects the scanning direction and that retain a plurality of liquids, the plurality of liquid retention portions feeding the plurality of liquids to the plurality of introduction openings of the head;

a mounting portion in which the plurality of liquid retention portions are mounted; and a plurality of flow channels that are provided in the mounting portion and supply the liquid to the head from the plurality of liquid retention portions, wherein:

the plurality of liquid retention portions include a black liquid retention portion that retains a black liquid, and among flow channel lengths of the plurality of flow channels, a flow channel length of a flow channel that supplies the black liquid is shortest.

2. The liquid ejecting apparatus according to claim 1, wherein at least a portion of the black liquid retention portion is disposed so as to overlap with the head when viewed in a planar manner.

3. The liquid ejecting apparatus according to claim 1, further comprising:

a support body that supports the head; and a guide shaft that supports the support body and sets the support body to be capable of moving in the scanning direction, wherein the head is supported on a side that is close to the guide shaft.

4. A liquid ejecting apparatus comprising:

a head comprising a plurality of introduction openings and a plurality of sets of nozzles, each set of nozzles corresponding to each of the plurality of introduction openings, the head receiving a corresponding liquid from each of at least one of the plurality of introduction openings and ejecting the corresponding liquid through the corresponding set of nozzles while moving in a scanning direction, the plurality of introduction openings being arranged in a direction parallel to the scanning direction;

a plurality of liquid retention portions having different retention capacities that are arranged in a direction that intersects the scanning direction and that retain a plurality of liquids, the plurality of liquid retention portions feeding the plurality of liquids to the plurality of introduction openings of the head;

a mounting portion in which the plurality of liquid retention portions are mounted; and a plurality of flow channels that are provided in the mounting portion and supply the liquid to the head from the plurality of liquid retention portions, wherein, among flow channel lengths of the plurality of flow channels, a flow channel length of a flow channel that supplies a liquid retained in a liquid retention portion having a greatest retention capacity is shortest.

5. The liquid ejecting apparatus according to claim 4, wherein at least a portion of the liquid retention portion having the greatest retention capacity is disposed so as to overlap with the head when viewed in a planar manner.

6. A liquid ejecting apparatus comprising:

a head comprising a plurality of introduction openings and a plurality of sets of nozzles, each set of nozzles corresponding to each of the plurality of introduction openings, the head receiving a corresponding liquid from each of at least one of the plurality of introduction openings and ejecting the corresponding liquid through the corresponding set of nozzles while moving in a scanning direction, the plurality of introduction openings being arranged in a direction parallel to the scanning direction;

a plurality of liquid retention portions that are arranged in a direction that intersects the scanning direction and that retain a plurality of liquids, the plurality of liquid retention portions feeding the plurality of liquids to the plurality of introduction openings of the head;

a mounting portion in which the plurality of liquid retention portions are mounted; and a plurality of flow channels that are provided in the mounting portion and supply the liquid to the head from the plurality of liquid retention portions, wherein, among flow channel lengths of the plurality of flow channels, a flow channel length of a flow channel that supplies a liquid having a greatest consumption amount among liquids retained in the plurality of liquid retention portions, is shortest.

7. The liquid ejecting apparatus according to claim 6, wherein at least a portion of a liquid retention portion that retains the liquid for which the consumption amount is greatest is disposed so as to overlap with the head when viewed in a planar manner.

* * * * *